US008752634B2

(12) United States Patent
Tanaka et al.

(10) Patent No.: US 8,752,634 B2
(45) Date of Patent: Jun. 17, 2014

(54) SEGMENTED SEAL RING AND SUPPORT OF SAME

(75) Inventors: Fabio Okamoto Tanaka, Spring, TX (US); Miguel A Garcia, Spring, TX (US)

(73) Assignee: Vetco Gray Inc., Houston, TX (US)

( * ) Notice: Subject to any disclaimer, the term of this patent is extended or adjusted under 35 U.S.C. 154(b) by 335 days.

(21) Appl. No.: 13/281,526

(22) Filed: Oct. 26, 2011

(65) Prior Publication Data

US 2013/0105143 A1 May 2, 2013

(51) Int. Cl.
*E21B 33/04* (2006.01)

(52) U.S. Cl.
USPC ..... 166/379; 166/75.14; 166/88.3; 166/208

(58) Field of Classification Search
CPC ..... E21B 33/04; E21B 33/03; E21B 33/043; E21B 43/10; E21B 2033/005
USPC ..... 166/379, 88.3, 88.1, 86.1, 75.13, 75.14, 166/208
See application file for complete search history.

(56) References Cited

U.S. PATENT DOCUMENTS

| | | | | |
|---|---|---|---|---|
| 3,866,650 | A | 2/1975 | Larkin | |
| 4,012,154 | A | 3/1977 | Durwin et al. | |
| 4,691,780 | A * | 9/1987 | Galle et al. | 166/348 |
| 4,784,222 | A * | 11/1988 | Ford | 166/208 |
| 4,949,786 | A * | 8/1990 | Eckert et al. | 166/208 |
| 5,076,356 | A * | 12/1991 | Reimert | 166/115 |
| 5,199,495 | A * | 4/1993 | Brammer et al. | 166/339 |
| 5,330,002 | A * | 7/1994 | Saunders | 166/208 |
| 6,557,644 | B1 * | 5/2003 | Miller et al. | 166/382 |
| 7,441,594 | B2 * | 10/2008 | Vanderford et al. | 166/75.14 |
| RE43,262 | E * | 3/2012 | June | 166/368 |
| 8,230,928 | B2 * | 7/2012 | Cuiper et al. | 166/338 |
| 8,347,970 | B2 * | 1/2013 | Vanderford et al. | 166/379 |
| 8,522,864 | B1 * | 9/2013 | Miller | 166/84.4 |
| 8,567,513 | B2 * | 10/2013 | Lacheny et al. | 166/379 |
| 2005/0252653 | A1 * | 11/2005 | Vanderford et al. | 166/75.14 |
| 2010/0206878 | A1 | 8/2010 | Haibel | |
| 2011/0036589 | A1 | 2/2011 | Rodgers et al. | |
| 2011/0095526 | A1 | 4/2011 | Vanderford et al. | |
| 2011/0266006 | A1 * | 11/2011 | Lacheny et al. | 166/379 |
| 2013/0105143 | A1 * | 5/2013 | Tanaka et al. | 166/86.1 |

OTHER PUBLICATIONS

GB Search and Examination Report dated Feb. 5, 2010 from corresponding Application No. GB1218961.9.

* cited by examiner

*Primary Examiner* — Jennifer H Gay
(74) *Attorney, Agent, or Firm* — Bracewell & Giuliani LLP

(57) ABSTRACT

A locking assembly for seals within inner and outer members. The locking assembly includes a segmented tube with an inner surface that is segmented into a plurality of pieces cut in radial or reversed angles to allow assembling segments in a circumferential groove machined in the internal diameter of a housing. The housing has an internal diameter that is smaller than the outside diameter of the segmented tube. The segments that make up the segmented tubing are locked into place within the housing via a bushing or locking ring that match a profile on the inner surface of the segmented tube to lockingly engage. The bushing and segmented tube retain a lower inner seal in place and support an upper inner seal. The segmented design of the segmented tube allows for smaller diameter members to be used and minimizes leak paths.

20 Claims, 4 Drawing Sheets

SEGMENTED SEAL RING AND SUPPORT OF SAME

FIELD OF THE INVENTION

This invention relates in general to valves and wellhead equipment, and in particular, to an internal locking device for retaining a sealing device within a valve or wellhead equipment.

BACKGROUND OF THE INVENTION

Typically, equipment designed for normal operation and for high pressures and high temperatures that is used in the oil and gas industry, requires sealing. As new seals are developed in the oil and gas industry to handle higher pressures and higher temperatures, the application of these seals can lead to issues on the overall design of the equipment. Usually internal grooves are machined allowing the assembly of soft seal materials, such as o-rings. However, when installing a tougher more robust seal, more space is typically required to lock the parts together. The size and assembly of the equipment that may result can present challenges in the design of the seal.

On certain types of equipment, such as valves, wellheads, subsea christmas trees, tubing spools, or production adapter bases, there may be issues related to the assembly condition of radial seals due to size constraints and load capacities. In a valve bonnet or in a wellhead, for example, a first seal may be installed within a packing gland or wellhead housing. A second seal or backup seal may also typically be installed that is separate from the first seal below. To keep the seal separate, a locking device is installed within the valve bonnet to hold the first seal in place while providing a shoulder or rim for the second seal or backup seal to land. A progressive drilled system is typically used to machine the internal portion of the bonnet or wellhead as this typically works well with soft materials. The locking device thus maintains the first seal in place and provides the second seal a shoulder on which to land.

However, in the design described above, separate parts are typically threaded together to form a seal groove and to allow for installation of the locking device. This can lead to secondary leak paths in the sealing system. To attempt avoidance of the secondary leak path, sealing systems are usually designed with larger bores and sizes. Maintaining the same size for lower and upper seals however is difficult without introducing additional leak paths that allow for installation. In certain oil and gas applications, this secondary leak path can be an issue, especially when sealing production fluids and gases. The larger bores lead to larger and heavier equipment which is also costlier.

A need exists for a technique to minimize the bore size of equipment via an improved locking device.

SUMMARY OF THE INVENTION

In an embodiment of the invention, a seal locking assembly includes a segmented tube or ring and a locking ring or bushing that allows for a design of seal grooves that accommodate seals required for certain sizes of the equipment or when mechanical properties of the seals are an issue.

In an embodiment of the invention, the segmented tubular, circular ring or tube, has a threaded internal diameter and is segmented with radial or reversed angle cuts that may alternate between adjacent segments to allow assembling each of the segments in a circular or circumferential groove machined in an internal diameter of a housing or adapter. The housing inner diameter is smaller than the outside diameter of the outer L-shaped portion that protrudes radially outward from the segmented tube. The protrusion of the segmented tube corresponds to the groove machined in the housing. After each of the segments are placed inside the internal circumferential groove of the housing, they are locked in place by means of the locking ring with external threads that match the internal threads of the segmented tube. Alternatively, locking may be achieved by a sliding interface. To prevent backing out of the locking ring, a set screw may be installed that traverses through locking ring, segmented tube, and into housing.

The assembled locking ring in conjunction with the segmented tube may retain a lower inner seal in place and also create an internal step or shoulder to an upper radial or circular seal. The shoulder provides sufficient support for assembling the seal in a groove located at inner diameter of housing. The shoulder also provides for sealing against devices, such as a stem, that may slidingly engage inner diameter of housing and of the locking ring.

This invention can be used in several types of equipment where a circular housing is present and there is a need to lock a seal in place or provide a locking feature. For example, the locking assembly can be used on shafts or stems that have axial movement relative to a housing and/or has a size constraint on seal designs. This invention may be applied for subsea and surface valves and actuators, radial seals of subsea wellhead tools, or any kind of equipment that requires a groove to assemble a radial seal or similar device and a secondary leak path is not allowable or is not desired.

Another technical advantage of the invention is that it allows the design of an internal locking mechanism for applications with size constraints, which may lead to reduced size and weight of equipment. For example, the invention allows for the use of radial seals with smaller cross sections or radial seals with hard material designs where the radial size of the equipment is a concern. Smaller and lighter equipment can potentially lead to a reduction in the overall cost of the equipment. Further, the invention can improve the design of other systems, such as subsea X-trees, tubing spools, or production adapter bases, where sizes and weights are limited by the installation and operating condition of the equipment.

DETAILED DESCRIPTION OF THE INVENTION

Figure 1:
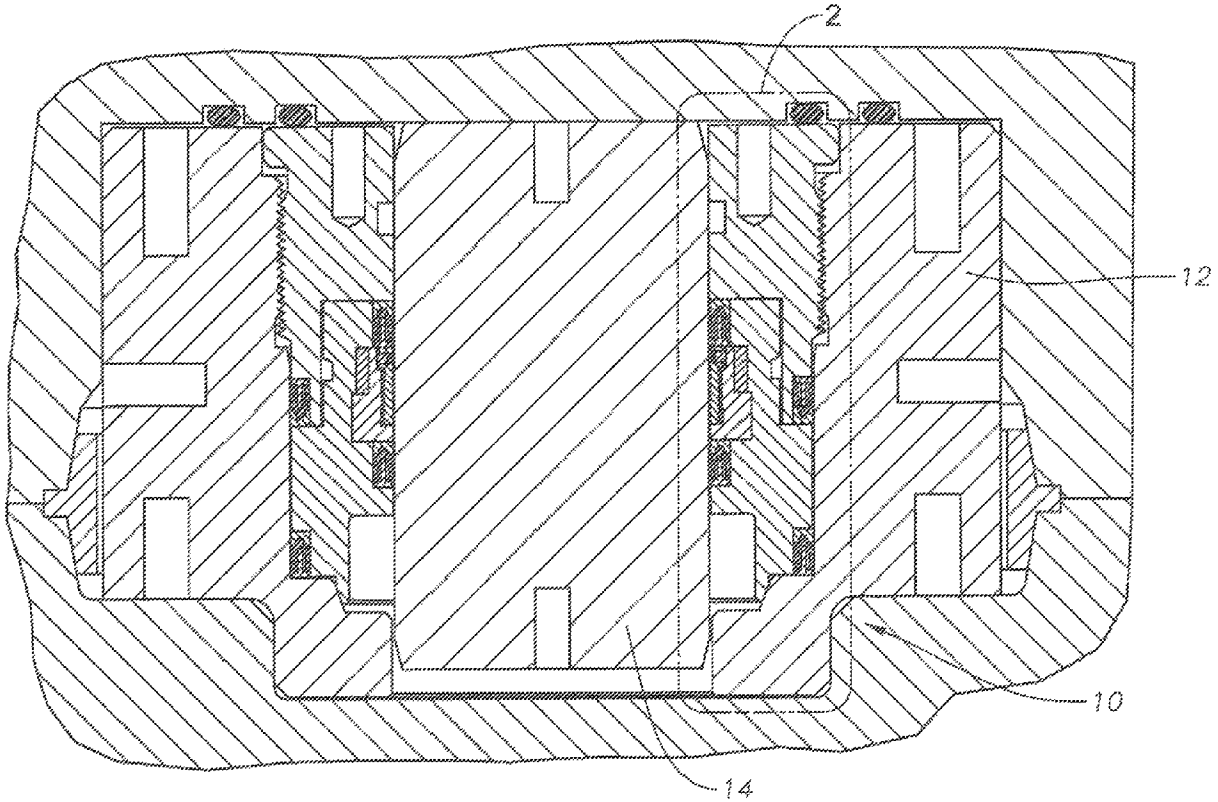
FIG. 1, illustrates a partial sectional view of an embodiment of the seal assembly locating within an outer and inner member, in accordance with the invention.

FIG. 1 shows a partial sectional view of an embodiment of a seal assembly 10 of the invention installed between an outer member 12 and an inner member 14. In this embodiment outer member 12 may be a valve bonnet. Alternatively, outer member may also be a wellhead housing or other type of housing where a seal assembly 10 could be used. In this embodiment, inner member 14 may be a valve stem. Alternatively, inner member 14 may also be a hanger, such as a casing hanger.

Figure 2:
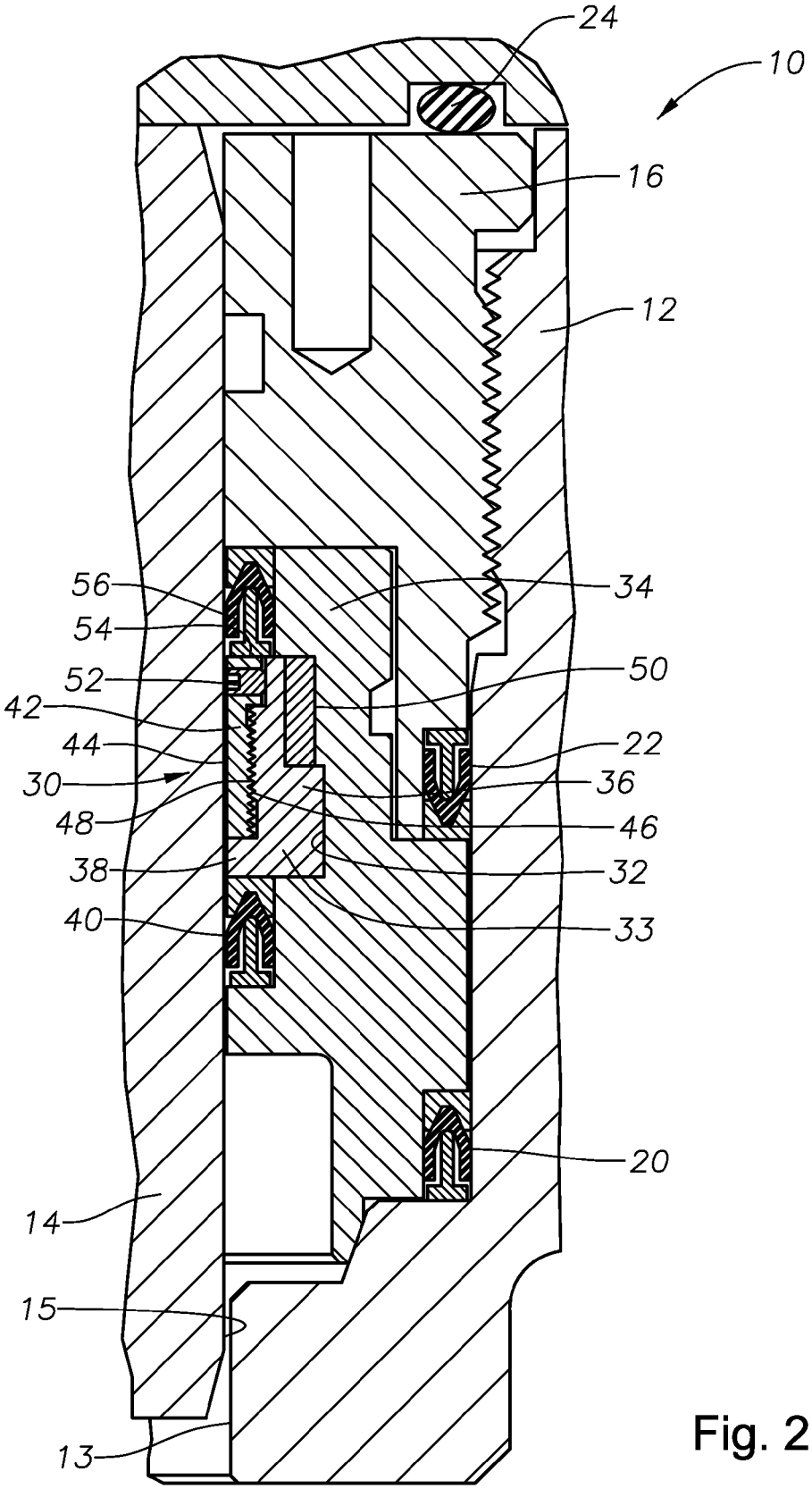
FIG. 2, illustrates a partial sectional view of the seal locking assembly of FIG. 1, in accordance with the invention.

Referring to FIG. 2, an enlarged sectional view of the seal assembly 10 of FIG. 1 is shown. In this embodiment, outer member or bonnet 12 has a bore 13 that may slidingly engage an outer surface 15 of the inner member or valve stem 14. O-ring type seal 20 is located at an interface between outer member 12 and an outer surface of seal assembly 10. Further, O-ring type seal 22 is located at an interface between upper member 16 and an outer surface of seal assembly 10. An additional seal 24 is located at a top portion of the outer member 12. Seals 20, 22, 24 provide sealing at leak paths created by interfaces between parts. A locking device 30 is located at an interface between bore 13 of outer member and outer surface 15 of inner member. Internal locking device 30 may be installed within a groove or recess 32 formed in a housing or packing gland adapter 34. Locking device 30 may include a cylindrical ring or tube 33 that has an L-shaped outer profile 36 that corresponds to a circumferential groove 32 of housing 34 and an L-shaped inner profile 38 that radially extends over a lower inner seal 40 to retain lower inner seal in place. Cylindrical tube 33 may be segmented and will be described below in further detail.

Continuing to refer to FIG. 2, a lower inner seal 40 is located between housing and inner member 34, 14 and provides a first seal between housing and inner member 34, 14. The locking device 30 also includes a bushing or locking ring 42 for lockingly engaging with the cylindrical tube 33 to maintain it within the housing 34. Bushing 42 has an inner diameter 44 facing inner member 14 and an outer surface 46 that engages an inner surface 48 of the cylindrical tube 33. Outer and inner surfaces 46 and 48 may be threaded to allow engagement. The components of the locking device 30 will be described further below in a discussion of FIGS. 3-5. A pin or dowel 50 may be used as a stop or for orienting the cylindrical tube 33, however it could also be omitted as shown in later Figures. To prevent the locking device from backing out of position once installed, a set screw 52 may be installed that traverses corresponding passages in the bushing 42 and cylindrical tube 33. Set screw 52 may be sheared during disassembly of seal assembly 10. An upper surface 54 of locking device 30 may then serve to support an upper inner seal 56 that can function as a secondary or backup seal to lower inner seal 40. The separation created between the lower and upper inner seals 40, 56 by the locking device 30 allows decoupling of forces placed on lower and upper inner seals, preventing upper seal from being crushed.

Figure 4:
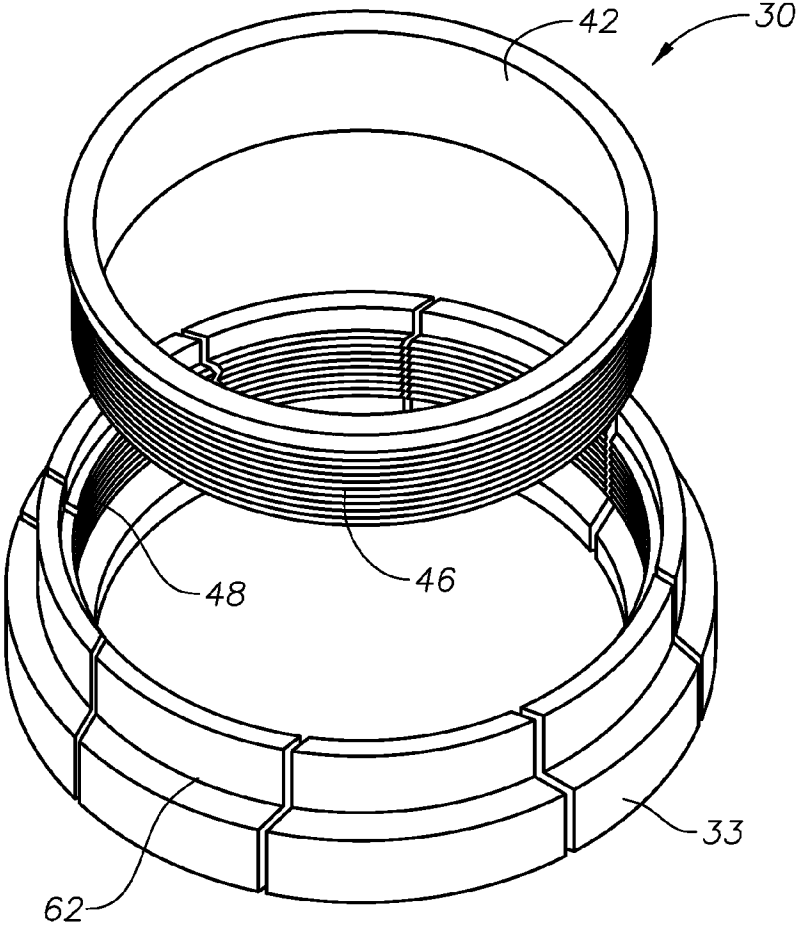
FIG. 4, illustrates partially exploded perspective view of the locking assembly of FIG. 3, in accordance with the invention.
Figure 3:
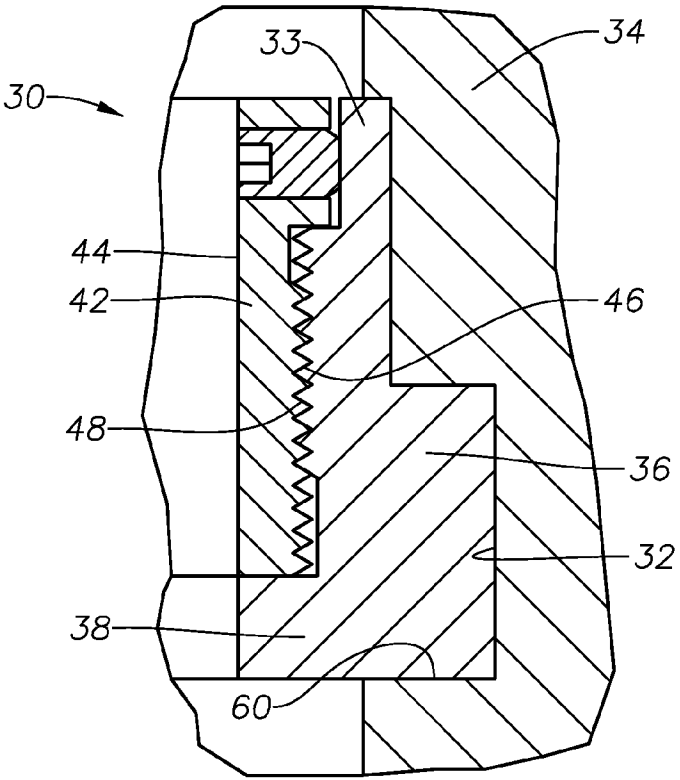
FIG. 3, illustrates a partial sectional view of an embodiment of a seal locking assembly, in accordance with the invention.
Figure 5:
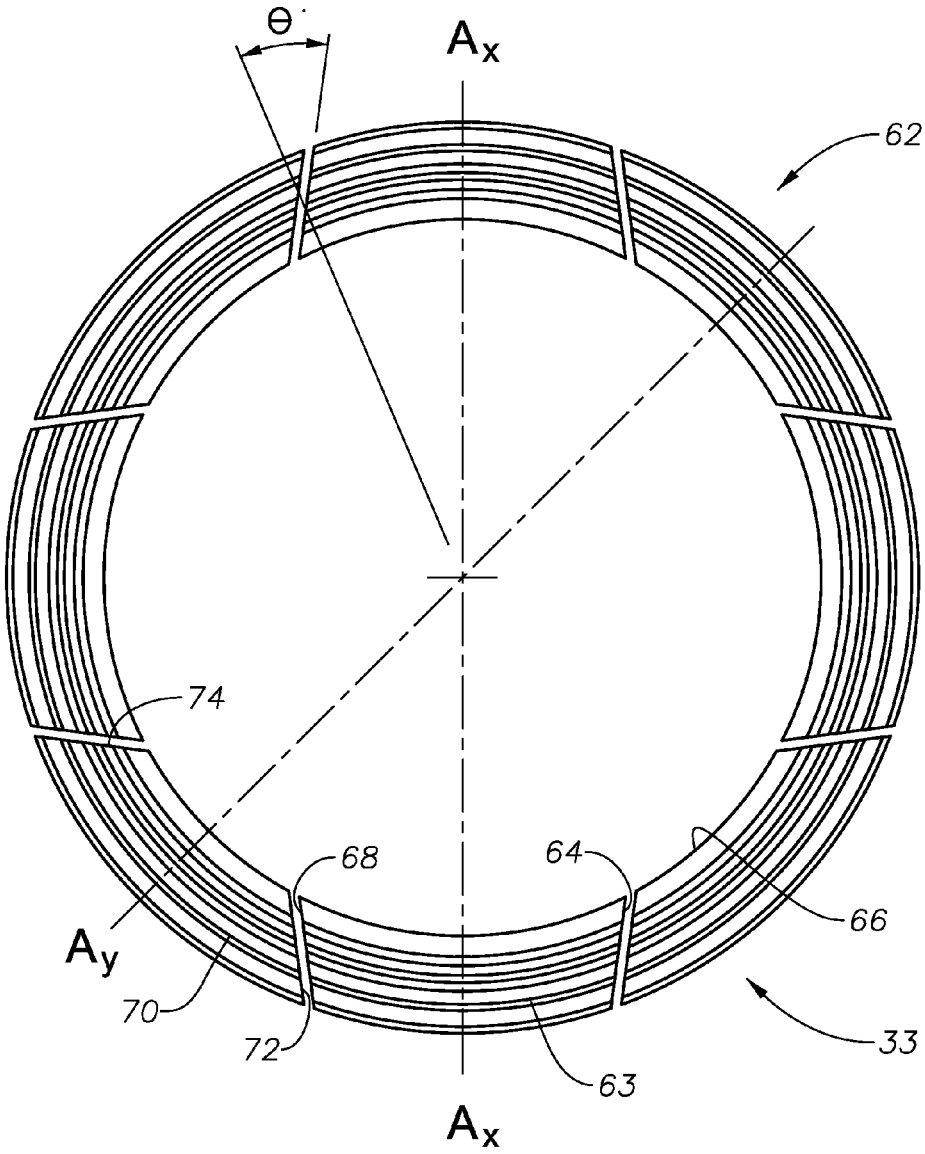
FIG. 5, illustrates a top view of a segmented tube shown in the embodiment of FIG. 4, in accordance with the invention.

Referring to FIGS. 3-5, the locking device 30 and its components are described further. FIG. 3 shows an enlarged view of an embodiment of the locking device 30. As previously explained L-shaped outer profile 36 of cylindrical tube 33 fits within groove 32 formed in housing 34. When mated in this fashion, axial movement between the cylindrical tube 33 and housing 34 is restricted. Further, the L-shaped outer profile 36 partially rests on upward facing shoulder 60 of groove 32, which also acts as a stop. To allow for installation of the cylindrical tube 33 within housing 34 via engagement of the L-shaped outer profile 36 with the groove 32, without requiring a larger bore size for the housing, the cylindrical tube 33 is segmented as shown in FIG. 5. Once tube segments 62 are installed within groove 32, the bushing 42 can be threaded into locking engagement with the segments 62 making up the cylindrical tube 33. Other types of locking devices or mechanism may also be used. For example a sliding mechanism having a latch-type lock or a helical mechanism with a spring-type lock may be used. Further, a roller-type with positive lock may also be used to achieve locking engagement. As previously explained threaded engagement is achieved by the threaded outer surface of bushing 42 and threaded inner surface 48 of each of the segments 62 that make up the cylindrical tube 33 as shown in the perspective illustration of FIG. 4. As previously mentioned, other types of locking mechanisms, such as a sliding interface, may be used. Machining precision is thus required to ensure alignment of threads of each segment 62. of in housing. Although the embodiment shown in FIG. 5 utilizes eight segments 62, it is understood that more or less segments may be utilized depending on the application and size of the cylindrical tube 33.

Referring to FIG. 5, a top view of the cylindrical tube 33 shows how the tube segments 62 are arranged to allow for their installation within housing 34 (FIG. 3), tube segments are cut in a novel way to allow for such installation. In this embodiment, a first tube segment 63 is cut in a novel fashion, with a first cut surface 64 extending radially outward towards inner diameter 66 of cylindrical tube 33. A second cut surface 68 is a mirror image of the first cut surface 66 about an axis Ax. First and second cuts on first tube segment 63 give segment a wedge shape, with a wider width at inner diameter 66 than at outer diameter. The opposite is true of an adjacent second tube segment 70, which has a first cut surface 72 that corresponds to second cut surface 68 on the first tube segment 63. Thus, first cut surface 72 on second tube segment 70 extends radially inward towards inner diameter 66 of cylindrical tube 33. On second tube segment 70, second cut surface 74 is a mirror image of first cut surface 72 about an axis Ay. As opposed to first tube segment 63, second and adjacent tube segment has a wider width at outer diameter than at inner diameter 66. Each cut surface for each tube segment is cut at an angle $\Theta$ which may vary from between about 10 to 70 degrees. In the embodiment shown, an angle $\Theta$ of 30 degrees is utilized. It is this novel segmented cylindrical tube 33 that allows locking device 30 to be advantageously installed within housing 34. This advantageously avoids creating an additional leak path which would result from needing to use an additional removable part above a one-piece-type tube to allow for installation.

During installation, referring to FIG. 2, the housing or packing gland adapter 34 is landed in outer member 12, such as a wellhead housing or valve bonnet. The lower inner seal 40, which may be elastomeric or metal-to-metal, may then be mounted in a recess in housing 34. Tube segments 62 (FIG. 4) making up the cylindrical tube 33 are then installed within housing 34 such that mating occurs with L-shaped outer profile 36 of each segment with groove 32 formed in the housing 34. Once installed, the tube segments 62 keep the inner lower seal 40 in place. The tube segments 62 are installed such that alternating angled cut surfaces correspond with each other. Bushing or locking ring 42 (FIG. 3) may then be threaded onto threads formed on tube segments 62 to lock segmented rings in place. Alternatively, a latch-type lock may slidingly lock the segments 62 in place or a helical mechanism with a spring-type lock may be used to lock the segments in place. Further, a roller-type with positive lock may also be used to achieve locking engagement of the segments 62. Set screws 52 (FIG. 2) can be installed to prevent backing out of bushing 42. Once busing 42 is installed, upper surface of bushing and tube segments 62 form an upward facing shoulder 54 (FIG. 3) for landing upper inner seal 56 as well.

Applications for this segmented tube feature of the invention can include installation in a bonnet of actuator valves, in a wellhead, or any application where one would want to minimize leak paths to the outside. Further, the invention allows for limitation of casing or bonnet sizes and eliminates drilling from outer to inner diameters.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A seal assembly, comprising:

an outer member having a bore;

an inner member adapted to be located in the bore;

a seal housing located between the inner and outer members, wherein the seal housing is received within a pocket formed on the outer member;

a cylindrical groove formed on an inner surface of the seal housing;

a segmented tube having an outward facing protrusion corresponding to the cylindrical groove when installed within the seal housing, wherein a plurality of segments comprising the segmented tube have edges cut at an angle such that the plurality of segments comprising the segmented tube that are adjacent to each other have surfaces cut in an alternating inward and outward sequence to allow adjacent segments of the plurality of segments to align and mate at the surfaces when installed within the cylindrical groove and to allow installation within the seal housing; and a bushing for lockingly engaging an inner profile of the segmented tube, wherein the bushing is located between the inner member and the segmented tube when installed.

2. The seal assembly of claim 1, further comprising a lower inner seal located within a seal recess formed in the seal housing adjacent to the inner member and below the segmented tube.

3. The seal assembly of claim 2, wherein a portion of the segmented tube extends radially inward over the lower inner seal to maintain the lower inner seal within the seal recess.

4. The seal assembly of claim 1, further comprising an upper inner seal located adjacent the inner member and supported by an upward facing shoulder formed by an upper surface of the bushing and an upper surface of the segmented tube.

5. The seal assembly of claim 1, wherein the angle of the cut is in a range from between about 10 degrees to about 70 degrees.

6. The seal assembly of claim 1, wherein the bushing has a locking mechanism comprising one of the following:

a.) an outward facing threaded profile for threadingly engaging a corresponding inward facing profile on the segmented tube; or b.) an outward facing profile for slidingly engaging a corresponding inward facing profile on the segmented tube.

7. The seal assembly of claim 1, wherein the segmented tube has an L-shaped outer profile for engaging the seal housing.

8. The seal assembly of claim 1, wherein a set screw traverses a passage on the bushing and the segmented tube to prevent unlocking of the bushing and the segmented tube.

9. The seal assembly of claim 1, wherein the outer member is a valve bonnet and the inner member is a valve stem.

10. The seal assembly of claim 1, wherein the outer member is a wellhead housing and the inner member is a casing hanger.

11. The seal assembly of claim 1, wherein the outer member is a valve bonnet and the inner member is a valve stem.

12. The seal assembly of claim 1, wherein the outer member is a wellhead housing and the inner member is a casing hanger.

13. A seal locking assembly, comprising:

a seal housing located between inner and outer members, wherein the seal housing is received within a pocket formed on the outer member;

a cylindrical recess formed on an inner surface of the seal housing;

a segmented tube having an outward facing protrusion corresponding to the cylindrical groove when installed within the seal housing, wherein a plurality of segments comprising the tube have edges cut at an angle such that the plurality of segments comprising the segmented tube that are adjacent to each other have surfaces cut in an alternating inward and outward sequence to allow adjacent segments of the plurality of segments to align and mate at the surfaces when installed within the cylindrical groove and to allow installation within the seal housing; and a bushing for lockingly engaging an inner profile of the segmented tube, wherein the bushing is located between the inner member and the segmented tube when installed.

14. The seal locking assembly of claim 13, further comprising:

a lower inner seal located within a seal recess formed in the seal housing adjacent to the inner member and below the segmented tube, wherein a portion of the segmented tube extends radially inward over the lower inner seal to maintain the lower inner seal within the seal recess;

an upper inner seal located adjacent the inner member and supported by an upward facing shoulder formed by an upper surface of the bushing and an upper surface of the segmented tube, wherein the lower and upper inner seals are the same size.

15. The seal locking assembly of claim 14, wherein the lower and upper inner seals are separated by the seal locking assembly, the seal locking assembly decoupling forces on the lower and upper inner seals.

16. The seal assembly of claim 13, wherein the angle of the cut is in a range from between about 10 degrees to about 70 degrees.

17. The seal assembly of claim 13, wherein the bushing has a locking mechanism comprising one of the following:

a.) an outward facing threaded profile for threadingly engaging a corresponding inward facing profile on the segmented tube; or b.) an outward facing profile for slidingly engaging a corresponding inward facing profile on the segmented tube.

18. The seal assembly of claim 13, wherein the segmented tube has an L-shaped outer profile for engaging the seal housing.

19. The seal assembly of claim 13, wherein a set screw traverses a passage on the bushing and the segmented tube to prevent unlocking of the bushing and the segmented tube.

20. A method for locking a seal assembly, comprising;

providing a seal housing located between inner and outer members, a cylindrical recess formed on an inner surface of the seal housing, a segmented tube having an outward facing protrusion corresponding to the cylindrical groove, wherein a plurality of segments comprising the tube have edges cut at an angle in alternating inward and outward sequence to allow installation within the seal housing; and a locking ring for lockingly engaging an inner profile of the segmented tube, wherein the locking ring is located between the inner member and the segmented tub;

landing the seal housing in outer member;

landing a lower inner seal within a seal recess formed in the seal housing;

installing the segments that comprise the segmented tube within the seal housing, wherein the outward facing protrusion of the segments mates with corresponding cylindrical groove in the seal housing;

engaging the locking ring into locking engagement with the segments comprising the segmented tube to lock the sealing assembly in place; and landing an upper inner seal on an upward facing shoulder formed by upper surface of the locking ring and upper surface of the seal housing.

* * * * *